US007284928B2

(12) United States Patent
Perez et al.

(10) Patent No.: US 7,284,928 B2
(45) Date of Patent: Oct. 23, 2007

(54) QUICK DISCONNECT COUPLING DEVICE

(76) Inventors: Ricardo Perez, 2512 Road 76, Pasco, WA (US) 99301; John Oldham, 3960 Alder Rd., Pasco, WA (US) 99301

( * ) Notice: Subject to any disclaimer, the term of this patent is extended or adjusted under 35 U.S.C. 154(b) by 218 days.

(21) Appl. No.: 11/112,087

(22) Filed: Apr. 19, 2005

(65) Prior Publication Data

US 2005/0271466 A1 Dec. 8, 2005

Related U.S. Application Data

(60) Provisional application No. 60/564,114, filed on Apr. 22, 2004.

(51) Int. Cl.
*B25G 3/18* (2006.01)

(52) U.S. Cl. ..... 403/322.2; 403/322.3; 403/325; 81/489; 16/422; 172/371

(58) Field of Classification Search ..... 403/322.2, 403/322.3, 325, 322.1; 172/371; 16/422, 16/426, 427; 81/489, 177.1, 177.85
See application file for complete search history.

(56) References Cited

U.S. PATENT DOCUMENTS 4,198,080 A * 4/1980 Carpenter ..... 403/325
4,663,796 A * 5/1987 Helling et al. ..... 81/177.85
5,779,385 A * 7/1998 Fechter ..... 403/325
6,270,085 B1 * 8/2001 Chen et al. ..... 279/22
6,726,393 B2 * 4/2004 Tsai et al. ..... 403/322.2
6,953,196 B1 * 10/2005 Huang ..... 81/177.85
7,013,765 B2 * 3/2006 Chang ..... 81/177.85

* cited by examiner

*Primary Examiner*—Daniel P. Stodola
*Assistant Examiner*—Michael P. Ferguson

(57) ABSTRACT

A quick disconnect assembly used for hand powered tools which consist of two separate units: a quick disconnect receiving assembly and an implement head attachment. When used together they will allow for a quick connection and release between a tool head and a handle. The first unit is a female receiving unit (quick disconnect receiving assembly) which consist of a exterior cylindrical shaped body throughout. One end being of cylindrical shape (handle sleeve and handle end) to receive a round to oval shaped handle and the opposite end having a hex shaped interior body (hex shaft receiver and hex shaft end). The second unit making up the quick disconnect assembly device is a male hex shaft implement head attachment.

6 Claims, 4 Drawing Sheets

QUICK DISCONNECT COUPLING DEVICE

CROSS REFERENCE TO RELATED APPLICATIONS

This application claims priority to U.S. Provisional Application No. 60/564,114, filed Apr. 22, 2004 the entire contents of which are incorporated herein by this reference.

TECHNICAL FIELD

This invention relates to hand tools. More specifically, this invention relates to a coupling device which allows a user to quickly remove and replace implement heads from a handle.

BACKGROUND OF THE INVENTION

There have been a number of attempts to provide a coupling device which allows a user to quickly remove and replace implement heads from a handle. To date, none of these prior art attempts have provided a solution that withstands rigorous work. Thus, there exists a need for a coupling device which allows a user to quickly remove and replace implement heads from a handle that will withstand rigorous work.

SUMMARY OF THE INVENTION

One object of this invention is to a coupling device which allows a user to quickly remove and replace implement heads from a handle that will withstand rigorous work.

BRIEF DESCRIPTION OF THE DRAWINGS

The following detailed description of the embodiments of the invention will be more readily understood when taken in conjunction with the following drawing, wherein.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

Figure 1:
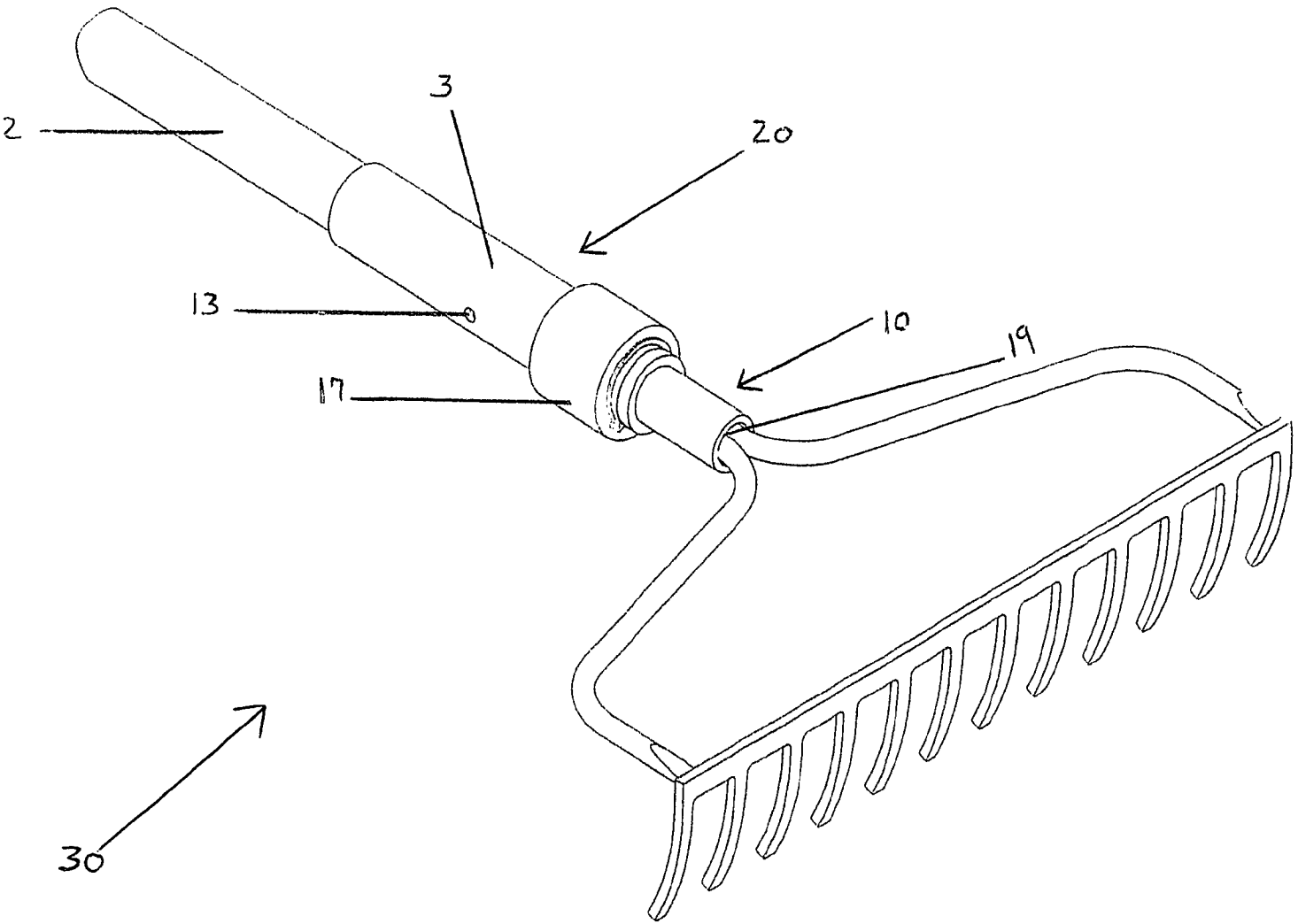
FIG. 1: is an illustration a preferred embodiment of the present invention showing the quick disconnect assembly consisting of a quick disconnect receiving assembly and an implement head attachment.

Referring to FIG. 1, there is shown the first embodiment of a garden tool constructed according to the teachings of the present invention, being identified generally as the quick disconnect assembly 30 which includes two main components: the first being a quick disconnect receiving assembly 20 and the second the implement head attachment 10. Parts that are immediately apparent on the quick disconnect receiving assembly 20 is the handle 2, handle sleeve 3, handle rivet 13, and sliding collar 17. The quick disconnect assembly's implement head attachment 10 has a tool head permanently attached to the implement head end 19. The implement head attachment 10 can include the following tool heads but are not limited to: shovel, rake, hoe, broom, hammer, sledge hammer, axe, scraper, squeegee, mop, paint brush and/or roller, without departing from the spirit of the present invention. While this preferred embodiment of the present invention is shown and described with the tools heads attached to the implement head attachment 10 and the handle attached to the disconnect receiving assembly 20, it will be apparent to those having ordinary skill in the art that the male and female ends can readily be reversed, and the present invention should be understood to encompass such arrangements. Other parts immediately apparent on the implement head attachment 10 are the flange 16 and the cylindrical shaped body 21 of the implement head end 19. The quick disconnect assembly 30 can be constructed for use in the lawn & garden, home cleaning, carpentry, and painting industries to make the connection and release of various tool heads interchangeable with one handle.

Figure 2:
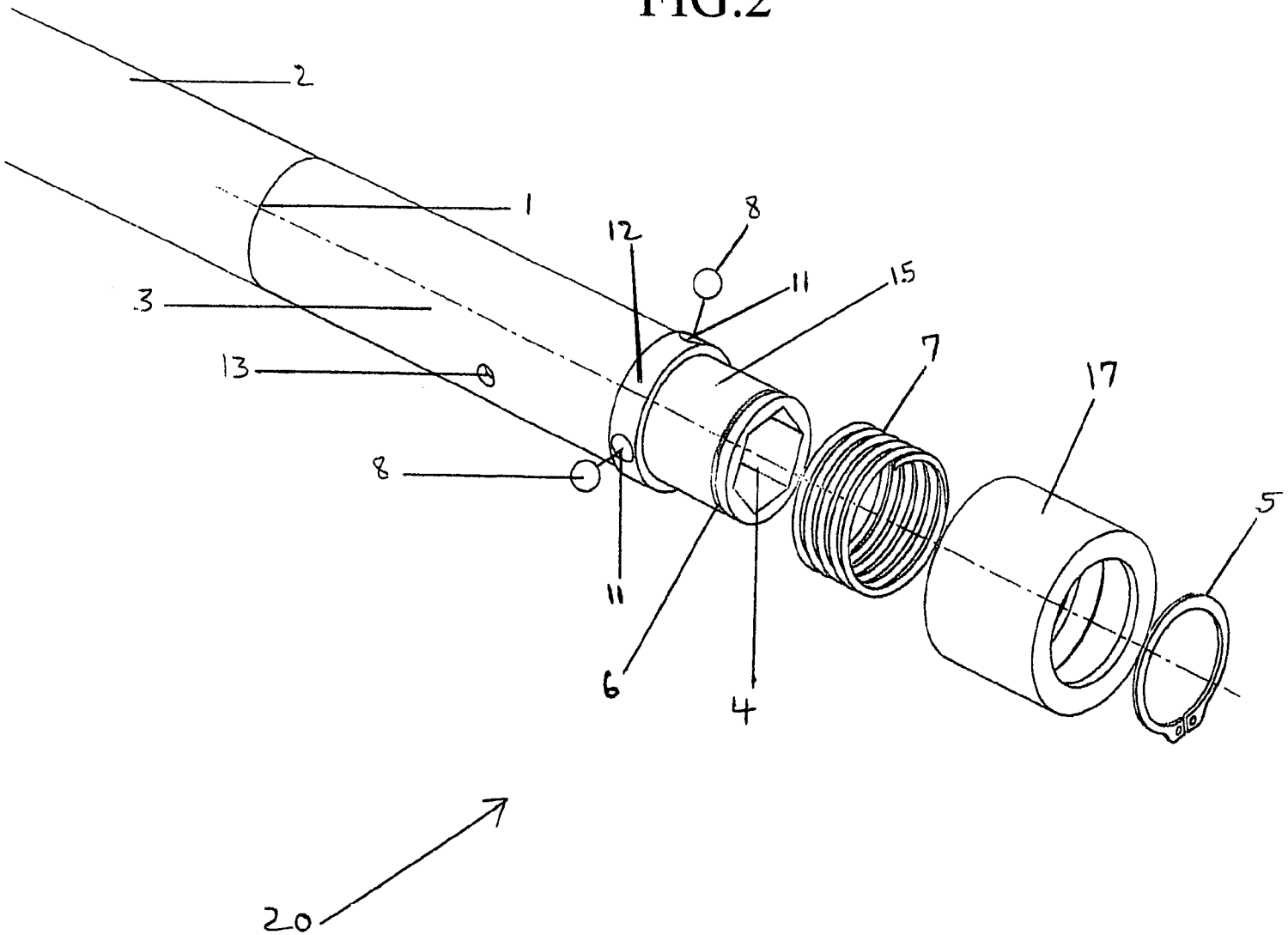
FIG. 2: is an exploded detailed illustration of the quick disconnect receiving assembly.

Referring to FIG. 2, there is shown a exploded detailed illustration of a main component of the present invention quick disconnect assembly 30 shown in FIG. 1. This main component is referred to as the quick disconnect receiving assembly 20 which consist of a handle sleeve 3 and handle end 1 to place a handle for control and use of the tool and a rivet 13 to secure the handle 2 in place. Illustrated between the handle sleeve 3 and the hex shaft receiver 15 is the raised edge 12 surrounding the exterior sidewall of the hex shaft receiver 15 which includes equally spaced, or as shown in the figure, not equally spaced locking ball holes 11 which accommodate locking balls 8. Illustrated is the sliding collar spring 7 which is placed on the outside exterior wall of the hex shaft receiver 15 and the sliding collar 17 which is placed over the sliding collar spring 7. Sliding collar 17 has spring wall 31 at one end and release groove 32 within the interior of sliding collar 17. Illustrated is the snap ring groove 6 which surrounds the exterior wall of the hex shaft receiver 15 at the hex shaft end 4. The internal parts of the quick disconnect receiving assembly 20 are held in place by sliding collar 17 and the tension created by the sliding collar spring 7 between the raised edge 12 and the snap ring 5 which is placed over and around the snap ring groove 6 and which is in contact with spring wall 31.

Figure 3:
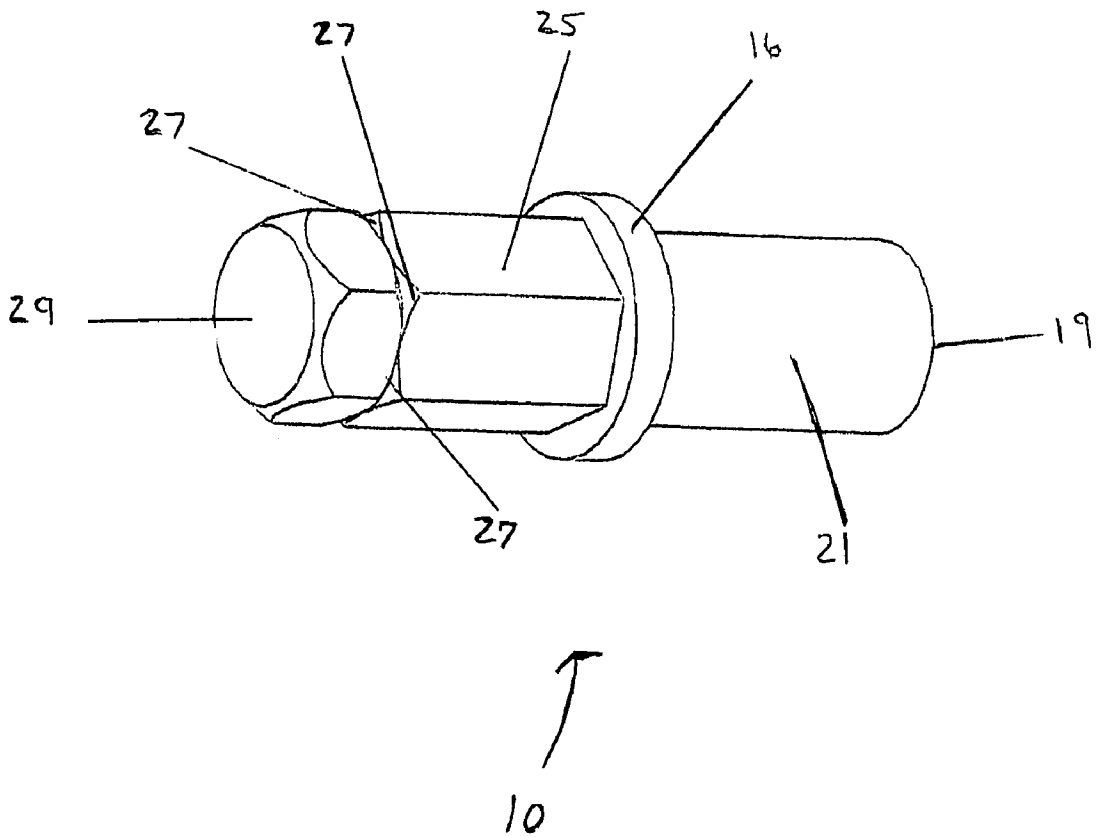
FIG. 3: is an exploded detailed illustration of the implement head attachment.

Referring to FIG. 3 there is shown a detailed illustration of a main component of the present invention quick disconnect assembly 30 shown in FIG. 1. This main component is referred to as the implement head attachment 10 to be used in conjunction with the quick disconnect receiving assembly 20 as shown in FIG. 1. The implement head attachment 10 consist of a hex shaft 25 with a hex chamfer end 29 and a engraved locking groove 27 surrounding the exterior wall of the hex shaft 25 located near the hex chamfer end 29. Located between the hex shaft 25 and the cylindrical shaped body 21 is a raised flange 16. The implement head end 19 of the implement head attachment 10 can be attached to a unique tool head that could consist of the following tool heads but not limited to: shovel, rake, hoe, broom, hammer, sledge hammer, axe, scraper, squeegee, mop, paint brush and/or roller, without departing from the spirit of the present invention.

Figure 4:
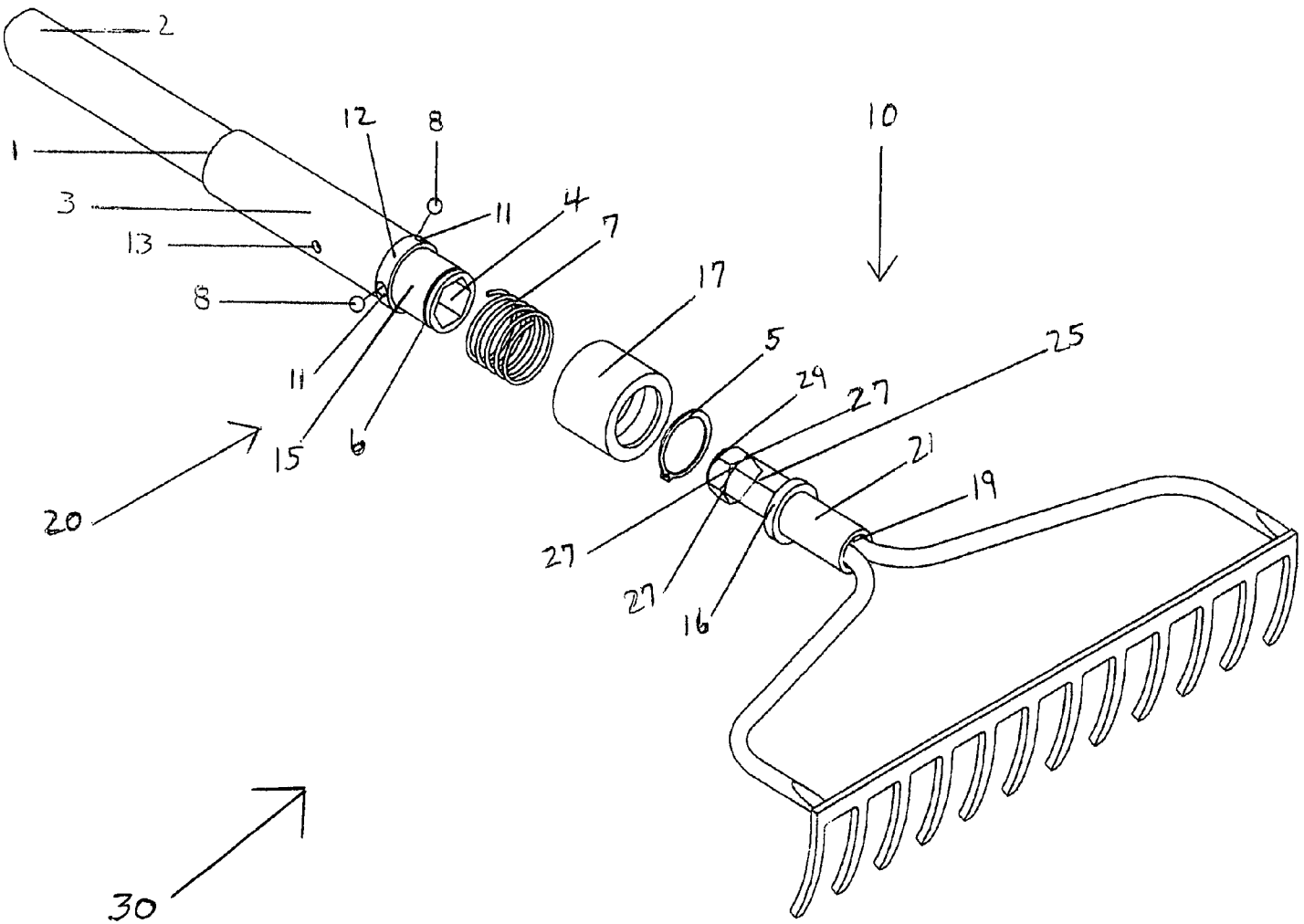
FIG. 4: is an exploded detailed illustration of the quick disconnect receiving assembly and the implement head attachment.

Referring to FIG. 4, which illustrates in detail an exploded view of the present invention quick disconnect assembly 30 embodying both the quick disconnect receiving assembly 20 and the implement head attachment 10. The sliding collar spring 7 is placed between the inside of the sliding collar 17 and the exterior wall of the hex shaft receiver 15. The locking balls 8 are placed in the locking ball holes 11 which are located inside the raised edge 12. A pressed or machined sliding collar 17 fits over the outside of the hex shaft receiver 15, the sliding collar spring 7, the locking balls 8, and the raised edge 12. These components, with the exception of the raised edge 12, are held together in place by the snap ring 5 being placed over and around the snap ring groove 6. When these components are secured in place the sliding collar 17 is retractable. To insert the hex shaft 25 of the implement head attachment 10 into the hex shaft receiver 15 of the quick disconnect receiving assembly 20 the sliding collar 17 is completely pulled downward (backwards) causing the bearings to retract outward into release groove 32 allowing the hex shaft 25 to be inserted up to the flange 16. The implement head attachment 10 can be locked together with the quick disconnect receiving assembly 20 by releasing upward (forward) the sliding collar 17 causing the locking balls 8 to retract back inward into the locking balls holes 11 of the raised edge 12 symmetrically fitting inside the locking grooves 27 of the hex shaft 25. Together in this fashion as described above they are inseparatable and rotate as a single entity.

The present invention conforms to the conventional forms of manufacture or any other standard way known to one skilled in the art. The entire quick disconnect assembly 30 as shown in FIG. 4 can be made from several different types and variations of plastic and steel. The manufacturing process varies and could include but is not limited to: injection molding, forging, pressing, stamping, broaching, casting or by machining.

Of course the present invention is not intended to be restricted to any particular form, arrangement, or any specific embodiment disclosed herein, or any specific use. The present invention description is intended only for illustration of an operative embodiment and not to show all of the various forms or modifications in which the present invention might be embodied or operated. Those skilled in the art shall be able to make numerous variations and modifications to it without departing from the spirit or scope of the invention hereinabove shown and described. However, the detailed description is not intended to limit the broad features or uses of the present invention.

The invention claimed is:

1. A coupling device used to connect tools and handles comprising:

a. a receiving assembly having a hex shaft receiver, said hex shaft receiver having snap ring groove, b. a raised edge disposed around said hex shaft receiver wherein said raised edge has at least one locking ball hole having at least one locking ball disposed within, c. a sliding collar having a release groove and a radially inwardly projecting spring wall disposed around said hex shaft receiver, d. a spring disposed around said hex shaft receiver between said hex shaft receiver and said spring wall, a first end of said spring abutting against said raised edge and a second end of said spring applying a biasing force against said spring wall of said sliding collar e. a snap ring disposed around said snap ring groove, holding said sliding collar on said hex shaft receiver, f. an implement head attachment having a hex shaft, a cylindrical shaped body, and a flange, therebetween wherein said hex shaft further has a locking groove and wherein when said hex shaft is inserted into said hex shaft receiver, said locking balls engage said locking groove, and wherein when said sliding collar is positioned such that said release groove is adjacent to said locking balls, said locking balls disengage from said locking groove.

2. The coupling device of claim 1, further comprising a hex chamfer end on said hex shaft.

3. The coupling device of claim 1, wherein said receiving assembly is further attached to a tool head.

4. The coupling device of claim 3, wherein said tool head is selected from the group consisting of a shovel, a rake, a hoe, a broom, a hammer, a sledge hammer, an axe, a scraper, a squeegee, a mop, a paint brush, and a roller.

5. The coupling device of claim 1, wherein said implement head attachment is further attached to a tool head.

6. The coupling device of claim 5, wherein said tool head is selected from the group consisting of a shovel, a rake, a hoe, a broom, a hammer, a sledge hammer, an axe, a scraper, a squeegee, a mop, a paint brush, and a roller.

* * * * *